US012048365B2

(12) United States Patent
Sheregar

(10) Patent No.: US 12,048,365 B2
(45) Date of Patent: Jul. 30, 2024

(54) PACKAGING DEVICE, NOTABLY FOR COSMETIC PRODUCTS AND/OR COSMETIC ACCESSORIES

(71) Applicant: L'Oreal, Paris (FR)

(72) Inventor: Venkatesh Sheregar, Shanghai (CN)

(73) Assignee: L'Oreal, Paris (FR)

( * ) Notice: Subject to any disclaimer, the term of this patent is extended or adjusted under 35 U.S.C. 154(b) by 589 days.

(21) Appl. No.: 17/293,851

(22) PCT Filed: Nov. 13, 2018

(86) PCT No.: PCT/IB2018/058894
§ 371 (c)(1),
(2) Date: May 13, 2021

(87) PCT Pub. No.: WO2020/099909
PCT Pub. Date: May 22, 2020

(65) Prior Publication Data

US 2022/0007811 A1 Jan. 13, 2022

(51) Int. Cl.
*A45D 40/24* (2006.01)
*A45D 33/24* (2006.01)

(52) U.S. Cl.
CPC ..... *A45D 33/24* (2013.01); *A45D 40/24* (2013.01)

(58) Field of Classification Search
CPC .... A45D 33/006; A45D 33/008; A45D 33/16; A45D 33/18; A45D 33/20; A45D 33/22;
(Continued)

(56) References Cited

U.S. PATENT DOCUMENTS 4,560,078 A * 12/1985 Dubuisson ..... A45D 33/00 220/8
4,807,773 A * 2/1989 Tsai ..... A45D 33/24 206/823

(Continued)

FOREIGN PATENT DOCUMENTS

FR 1304190 A 9/1962
TW M493302 1/2015

OTHER PUBLICATIONS

International Search Report mailed Jul. 18, 2019, issued in corresponding International Patent Application No. PCT/IB2018/058894, filed Nov. 13, 2018, 3 pages.

(Continued)

*Primary Examiner* — Cris L. Rodriguez
*Assistant Examiner* — Karim Asqiriba
(74) *Attorney, Agent, or Firm* — Christensen O'Connor Johnson Kindness PLLC

(57) ABSTRACT

The device comprises a main tray 12 provided with an upper face 12*a* delimiting at least one compartment 16, and a lid 14 rotatably mounted on the main tray 12 between a closed position in which said lid covers at least said compartment 16, and at least one open position allowing access to said compartment. The main tray comprises a protruding pin 22 around which is rotatably mounted the lid 14, said lid comprising at least one snapping element cooperating with at least one complementary snapping element of the pin. The main tray further comprises a hole 34 extending from a lower face of said main tray and adapted for receiving a pin of an additional tray, said hole 34 being configured to delimit at least one snapping element adapted to cooperate with at least one complementary snapping element of the pin of said additional tray.

14 Claims, 5 Drawing Sheets

(58) Field of Classification Search
CPC ..... A45D 33/24; A45D 33/26; A45D 40/00; A45D 40/0068; A45D 40/22; A45D 40/24; A45D 40/221; A45D 42/02
USPC ..... 206/581, 823
See application file for complete search history.

(56) References Cited

U.S. PATENT DOCUMENTS

D328,817 S * 8/1992 Holland ..... D3/270
5,423,434 A * 6/1995 Chen ..... G11B 33/0455 211/163
6,145,515 A * 11/2000 Wu ..... A45D 40/24 132/294
6,378,533 B1 * 4/2002 Roman ..... A45D 33/006 220/4.27
8,651,308 B1 * 2/2014 Sung ..... A45D 40/00 220/4.24
8,919,355 B2 * 12/2014 Blanch ..... A45D 40/221 206/823
2007/0204876 A1 * 9/2007 Allen ..... A45D 33/006 132/294
2014/0318569 A1 * 10/2014 Bueti ..... A45D 33/20 132/295
2017/0320624 A1 * 11/2017 Huang ..... B65D 21/022
2018/0018482 A1 * 1/2018 Jammet ..... A45D 40/0068
2018/0199690 A1 * 7/2018 Steele ..... A45D 33/006

OTHER PUBLICATIONS

Written Opinion mailed Jul. 18, 2019, issued in corresponding International Patent Application No. PCT/IB2018/058894, filed Nov. 13, 2018, 5 pages.

* cited by examiner

PACKAGING DEVICE, NOTABLY FOR COSMETIC PRODUCTS AND/OR COSMETIC ACCESSORIES

CROSS-REFERENCE TO RELATED APPLICATION

This application is a National Stage Application of PCT/IB2018/058894, filed Nov. 13, 2018, the disclosure of which is hereby incorporated by reference in its entirety.

FIELD OF THE INVENTION

The present invention relates to a packaging device for storing and packaging products and/or accessories.

One advantageous application of the invention is the use of the packaging device for storing and packaging cosmetic products in the form of a powder or of a compact, and/or cosmetic accessories. By way of example, a device of this type may be used for storing and packaging make-up products such eye shadows or lip rouges.

BACKGROUND OF THE INVENTION

The expression "cosmetic product" is understood to mean a product as defined in Article 2 of Regulation No. 1223/2009 of the European Parliament and of the Council of 30 Nov. 2009.

Classically, a multiple-compartment device comprises a base or tray delimiting a plurality of compartments each containing a cosmetic product, and a lid rotatably mounted on the tray and movable between an open position allowing access to the compartments and a closed position. For more details, it is possible for example to refer to patent application US-A1-2007/0204876.

Such type of device has the major drawback of having a fixed number of compartments for receiving the cosmetic products.

It is a particular object of the present invention to overcome this drawback.

SUMMARY OF THE INVENTION

The invention relates to a packaging device comprising a main tray provided with an upper face delimiting at least one compartment receiving at least one cosmetic product and/or at least one cosmetic accessory, and a lid rotatably mounted on the main tray between a closed position in which said lid covers at least said compartment of the main tray, and at least one open position allowing access to said compartment.

DESCRIPTION OF THE DRAWINGS

The present invention and its advantages will be better understood by studying the detailed description of a specific embodiment given by way of non-limiting example and illustrated by the appended drawings on which.

DETAILED DESCRIPTION OF THE INVENTION

Figure 2:
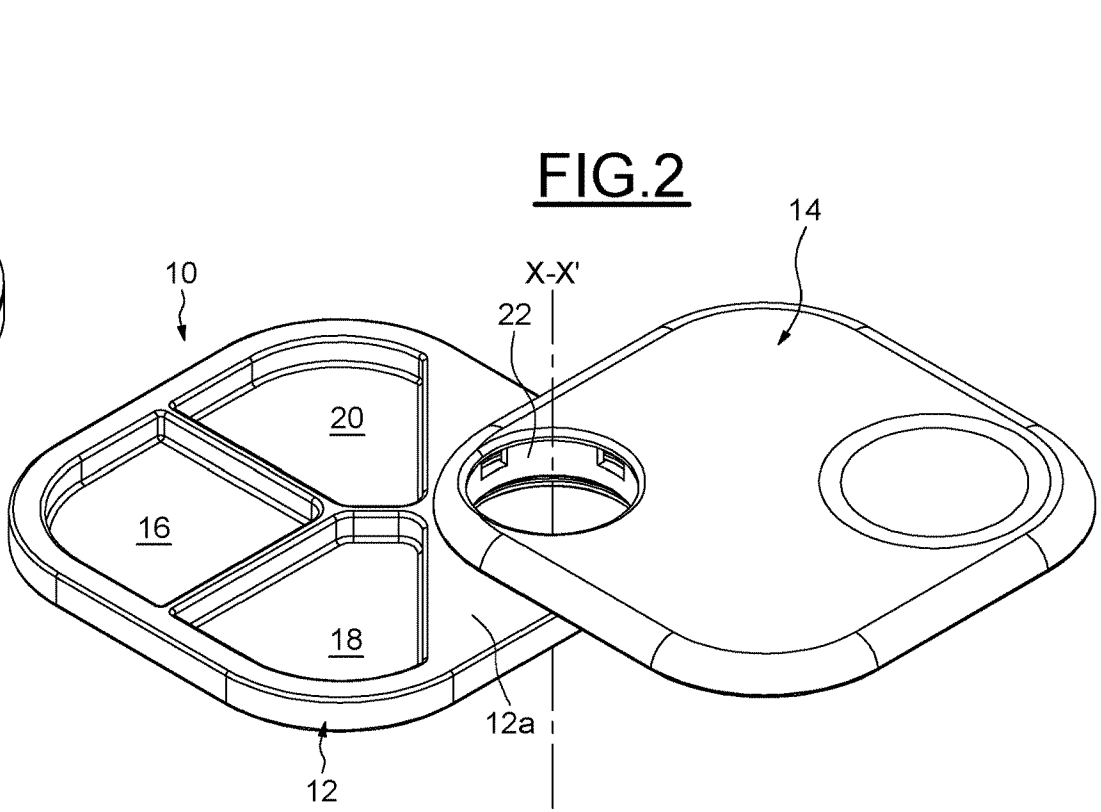
FIG. 2 is a perspective view of the packaging device of FIG. 1 in an open position.

The invention relates to a packaging device comprising a main tray provided with an upper face delimiting at least one compartment receiving at least one cosmetic product and/or at least one cosmetic accessory, and a lid rotatably mounted on the main tray between a closed position in which said lid covers at least said compartment of the main tray, and at least one open position allowing access to said compartment.

According to a general feature, the main tray comprises a pin protruding with respect to the upper face and around which is rotatably mounted the lid. Said lid comprises at least one snapping element cooperating with at least one complementary snapping element of the pin of the main tray.

According to another general feature, the main tray further comprises a hole extending from a lower face of said main tray and adapted for receiving a pin of an additional tray. Said hole is configured to delimit at least one snapping element adapted to cooperate with at least one complementary snapping element of the pin of said additional tray.

With such design of the main tray, the user can easily stack one or a plurality of additional trays from below in order to obtain the desired pallet of products. Each additional tray can be snap-fitted on the main tray or on the previous additional tray already clipped on said main tray. Otherwise, each tray may be easily removed by the user when the products contained are finished.

Therefore, the packaging device is designed in a way that "n" number of additional trays can be further stacked under the main tray. This gives user the flexibility to carry all the make-up in one device in a very handy form.

As previously indicated, the lid is rotatably mounted on the main tray between a closed position and at least one open position allowing access to the compartment(s) of the main tray. Similarly, when an additional tray is stacked under the main tray, said main tray is rotatably mounted around the pin of the additional tray between a closed position and at least one open position allowing access to the compartment(s) of the additional tray.

The pin of each tray performs a dual function, namely to enable the rotary mounting of the lid, or of the previous tray if the trays are stacked, and to axially retain said lid or said previous tray.

Preferably, the pin and the hole of the main tray are arranged coaxially. The hole of the main tray may open onto an upper face of said main tray.

Advantageously, the lid comprises a through-hole which is coaxial with the hole of the main tray to collectively extend throughout the thickness of said packaging device.

Accordingly, the user can easily hold the device in the palm of one hand and can introduce one finger of the same hand, for example the index. This helps the user to hold the packaging device in place.

Otherwise, such a design allows the user to easily hook the packaging device, for example on a bag, or it can also be treated as a keychain.

Preferably, the through-hole of the lid is configured to delimit the snapping element of said lid. Advantageously, the snapping element of the hole of the main tray is identical to the snapping element of the lid.

In one embodiment, the pin of the main tray comprises at least one protrusion extending radially outwards and forming the complementary snapping element, and the lid comprises at least one rib forming the snapping element.

According to a specific configuration, at least one of the upper face of the main tray and the lower face of the lid comprises at least one locking rib engaging into a complementary recess of the other in the closed position of said lid. This prevents accidental openings of the lid.

Preferably, in the closed position, the lid overlaps the main tray and is superposed relative to said main tray.

The term "superposed" should be understood as meaning in complete axial alignment and not just partially overlapping.

With such an arrangement, the global size of the device is limited in the closed position.

In one embodiment, a finger depression is formed on an upper face of the lid and is adapted to receive at least one finger of a user.

In one embodiment, the upper face of the main tray may delimit a plurality of compartments. The plurality of compartments may contain different cosmetic products and/or different cosmetic accessories.

The packaging device may further comprise at least one additional tray identical to the main tray and mounted on said main tray axially on the side opposite to the lid, the snapping element of the hole of the main tray cooperating with the complementary snapping element of the pin of the additional tray, the main tray being rotatably mounted around said pin on the additional tray between a closed position in which said main tray covers the at least one compartment of the additional tray, and at least one open position allowing access to said compartment.

The invention also relates to a tray for a packaging device as previously defined, comprising an upper face delimiting at least one compartment receiving at least one cosmetic product and/or at least one cosmetic accessory, a pin protruding with respect to the upper face, at least one snapping element provided on said pin, and a hole extending from a lower face of said tray and adapted for receiving a pin of an additional tray, said hole being configured to delimit at least one snapping element adapted to cooperate with at least one complementary snapping element of the pin of said additional tray.

Figure 1:
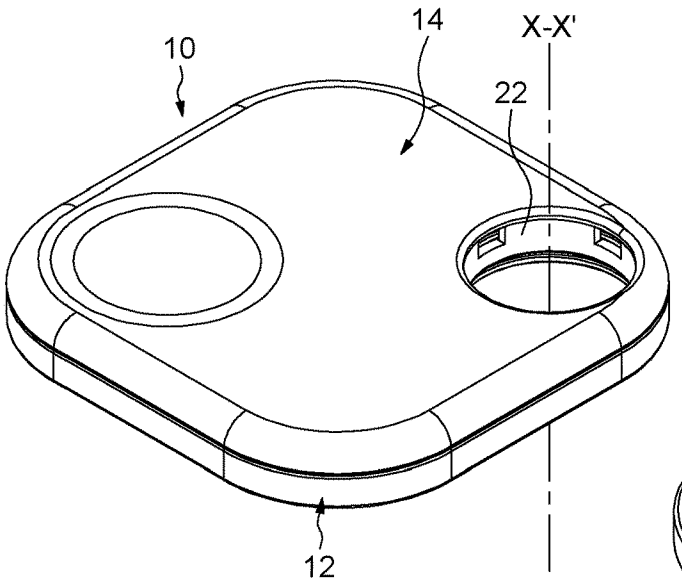
FIG. 1 is a perspective view of a packaging device in a closed position according to an example of the invention.

FIGS. 1 and 2 show an example of a packaging device, denoted by the general reference number 10, for storing and packaging cosmetic products. FIGS. 1 and 2 represent the device 10 in a state that is assumed to be horizontal.

The device 10 comprises a base or main tray 12 and a lid 14 rotatably mounted on the tray around a vertical axis X-X' to cover said tray. The lid 14 is movable around the axis X-X' between a closed storage position illustrated in FIG. 1 and at least one open use position illustrated in FIG. 2. The tray 12 and the lid 14 are each made in one part, for example from moulding of plastic material such as polypropylene.

As will be described later, the tray 12 is designed to allow the snap-fitting of an additional tray from below.

Figure 4:
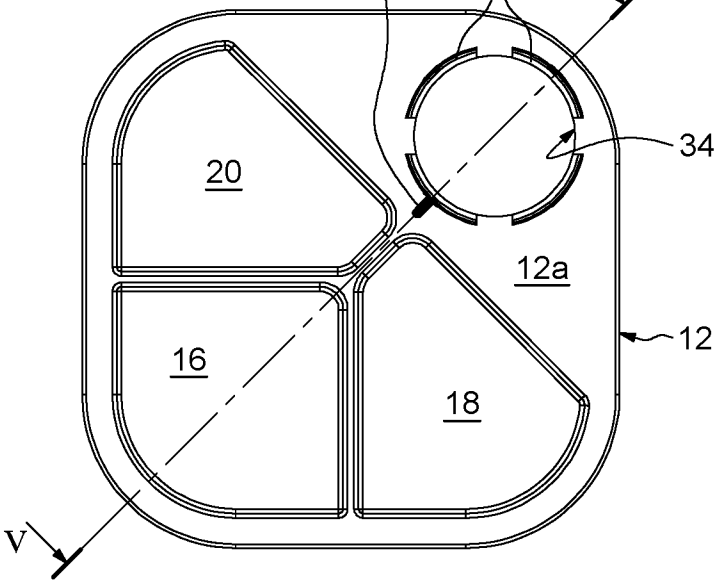
FIG. 4 is a top view of the main tray of FIG. 3.
Figure 3:
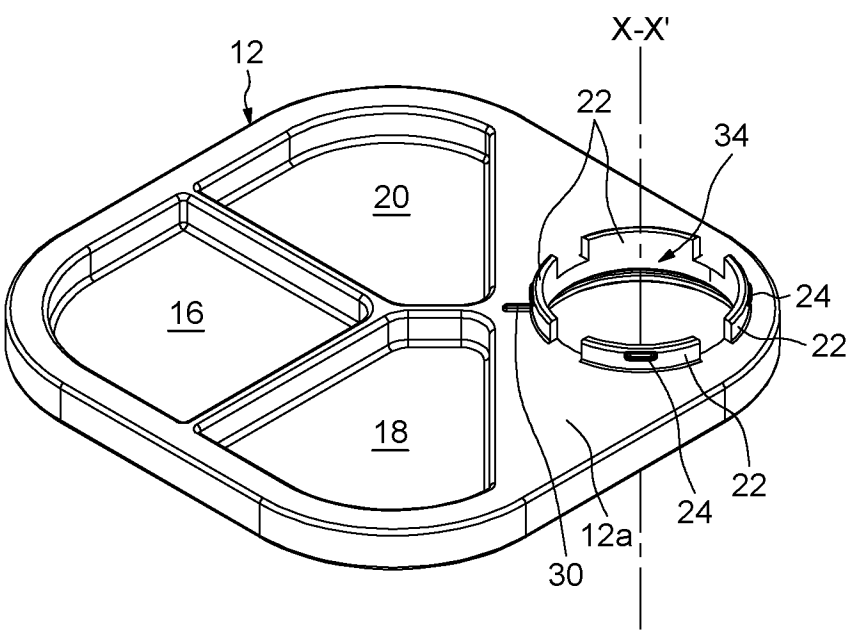
FIG. 3 is a perspective view of a main tray of the packaging device of FIGS. 1 and 2.

As shown more clearly on FIGS. 3 and 4, the tray 12 is in the shape of a square with rounded corners. Alternatively, the tray 12 may have different shapes, for example rectangular, oval, etc. or also in the shape of a disk portion.

Figure 5:
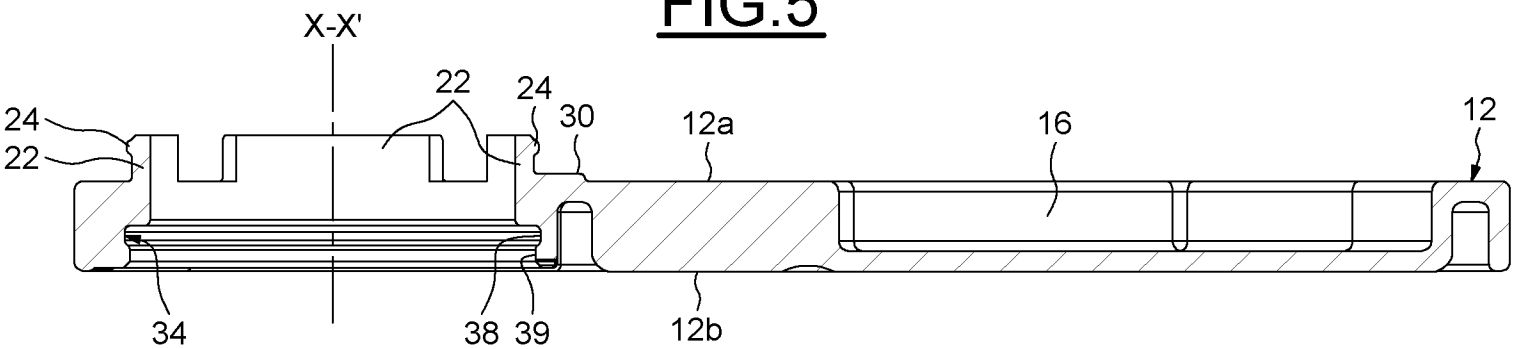
FIG. 5 is a section on V-V of FIG. 4 on a larger scale.

The tray 12 delimits a plurality of compartments 16 to 20 for receiving different cosmetic products (not shown). More precisely, an upper face 12*a* of the tray 12 delimits the compartments 16 to 20. The compartments 16 to 20 are oriented axially upwards. The compartments 16 to 20 are separate one from another. The tray 12 is axially delimited by the upper face 12*a* and an opposite lower face 12*b* (FIG. 5). The upper face 12*a* of the tray is oriented axially towards the lid 14. In its closed position, the lid 14 recovers the tray 12 and the compartments 16 to 20.

As shown on FIGS. 2 to 5, the tray 12 further comprises a pin 22 for allowing the pivotal movements of the lid 14 about the axis X-X'. The pin 22 forms a journal. The lid 14 is journalled on the pin 22. The pin 22 is axially located on the tray 12 on side of the compartments 16 to 20. The pin 22 axially protrudes upwards from the upper face 12*a*. Here, the pin 22 is made in one part with the tray 12. Alternatively, the pin 22 and the tray 12 may be made in two parts. In the illustrated example, the pin 22 is not continuous in the circumferential direction. In other words, the pin 22 is composed of spaced sectors evenly spaced relative to one another in the circumferential direction, here four. Alternatively, the pin 22 may be annular.

The pin 22 comprises a plurality of protrusions 24 extending outwards. The protrusions 24 are provided on the outer surface of the pin 22. As will be described later, the protrusions 24 form hooks in order to secure the lid 14 on the tray 12 by snap-fitting. The protrusions 24 are directed radially outwards. In the illustrated example, the protrusions 24 are formed at the free end of the pin 22. In the illustrated example, one protrusion 24 is provided on each spaced sector of the pin 22. In the alternative embodiment in which the pin 22 is annular, said pin may comprise only one annular protrusion or a plurality of spaced protrusions.

As previously indicated, the lid 14 is movable between a closed position and at least one open use position. The lid 14 recovers the tray 12 in its closed position. The lid 14 is dimensioned so that said lid and the tray 12 are overlapping and superposed in the closed position. Accordingly, the lid 14 has the same shape that the tray 12. In the use position, the lid 14 allows access to the compartments 16 to 20. In this use position, the lid 14 protrudes in the circumferential direction relative to the tray 12. Thus the lid 14 and the tray 12 are substantially non-overlapping.

Figure 6:
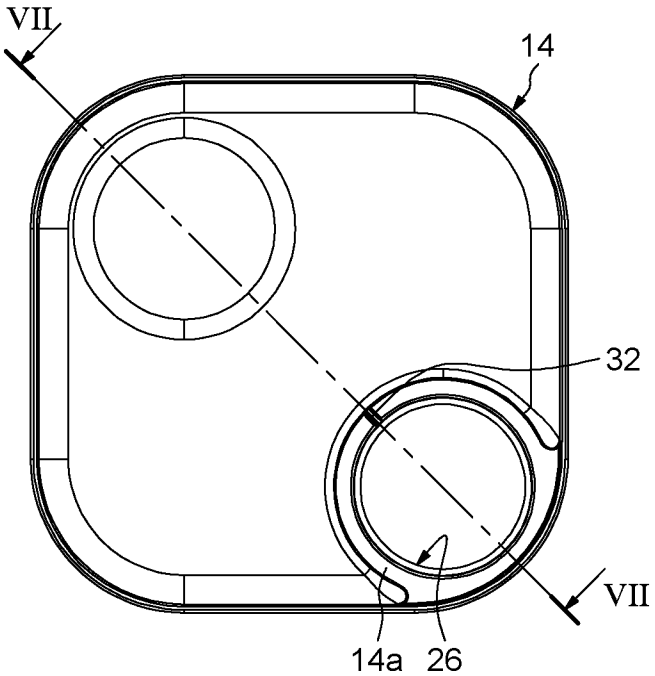
FIG. 6 is a bottom view of a lid of the packaging device of FIGS. 1 and 2.
Figure 7:
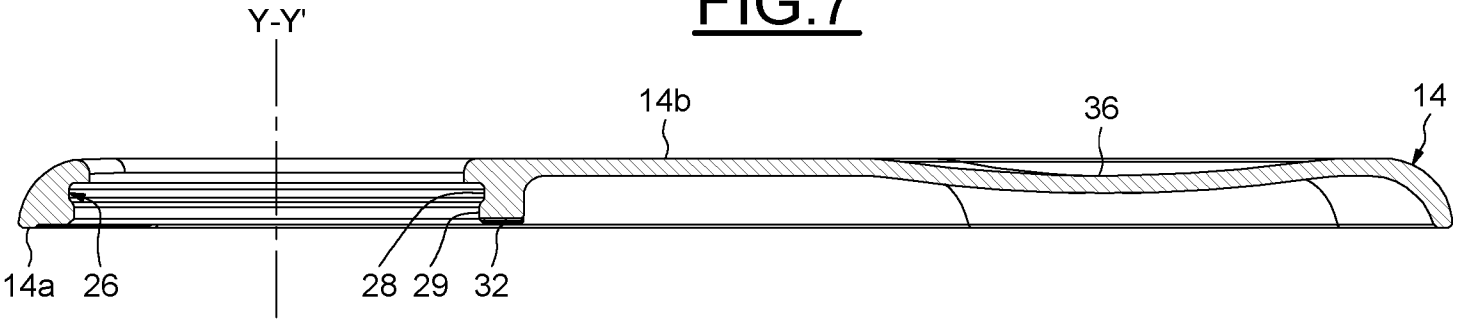
FIG. 7 is a section on VII-VII of FIG. 6 on a larger scale.

As shown more clearly on FIGS. 6 and 7, the lid 14 comprises a through-hole 26 made into its thickness. The through-hole 26 extends axially from a lower face 14*a* of the lid to an opposite upper face 14*b*. The lower face 14*a* of the lid is oriented axially towards the upper face 12*a* of the tray. The lid 14 is axially delimited by the lower face 14*a* and the upper face 14*b*.

The through-hole 26 of the lid extends along an axis Y-Y', which is coaxial with the axis X-X'. The through-hole 26 has a stepped shape and delimits an annular groove 28 extending radially outwards. The through-hole 26 also delimits an annular retaining rib 29 directed radially inwards. The rib 29 is axially disposed above the groove 28. More precisely, the top surface of the rib 29 forms the bottom surface of the groove 28.

In the mounted position of the lid 14 on the tray as shown on FIGS. 1 and 2, the pin 22 of the tray extends into the through-hole 26 of the lid, and the protrusions 24 of said pin are engaged within the groove 28 of said through-hole. The bottom surface of each protrusion 24 axially bears against the top surface of the rib 29. The external diameter of the protrusions 24 is greater than the inner diameter of the rib 29 so that a diametral interference exists between the lid 14 and the tray 12 to prevent an axial displacement of said lid 14 upwards.

The rib 29 of the lid forms a snapping element cooperating by contact with complementary snapping elements of the tray 12 formed by the protrusions 24. Accordingly, the lid 14 is secured on the tray 12 by snap-fitting. The lid 14 is mounted on the tray 12 with a simple axial pushing movement.

In order to maintain the lid 14 secured on the tray 12 in the closed position, the upper face 12*a* of said tray is provided with a rib 30 (FIGS. 3 to 5) protruding axially upwards and engaging into a complementary recess 32 (FIGS. 6 and 7) formed on the lower face 14*a* of the lid. In the closed position of the lid 14, the rib 30 of the tray cooperates with the recess 32 of the lid such that said lid remains in the closed position unless and until intentionally manually moved to the open configuration.

In the illustrated example, the rib 30 extends form the pin 22. Alternatively, it is possible to provide other dispositions of the rib 30 on the upper face 12*a* of the tray, for example near to one of corners of the tray. It could be also possible to provided more than one locking rib 30.

As shown on FIGS. 3 and 5, the tray 12 comprises a hole 34 extending from the lower face 12*b* of the tray into the thickness of said tray. The hole 34 opens onto the upper face 12*a* of the tray. The axis of the hole 34 is coaxial with the axis X-X'. Thus, the pin 22 and the hole 34 are also arranged coaxially. The hole 34 of the tray is coaxial with the through-hole 26 of the lid to collectively define an aperture extending throughout the entire thickness of the device 10.

From the closed position of the device 10 shown in FIG. 1, the user holding the device in the palm of one hand can introduce one finger of the same hand, for example the index, through the aperture defined by the hole 34 of the tray and the through-hole 26 of the lid. This helps the user to hold the device 10 in place.

Then, the user can rotate, with one finger of the other hand, the lid 14 in the clockwise direction, or in the counter-clockwise direction, in order to open the device and to allow the access to compartments 16 to 20 of the tray. In order to facilitate the rotation of the lid 14, a finger depression 36 (FIG. 7) is formed on the upper face 14*b* of said lid.

Once device 10 is opened, the user can access cosmetic products (not shown) contained inside the compartments 16 to 20 of the tray. For example, cosmetic products may be three different shades of product which is used in correcting the skin tones for all type of complexion. The different shades may for example consist of neutralizer, concealer and blur. Alternatively, other type of cosmetic products may be contained inside the tray 12. It is also possible to dispose inside one of the compartments 16 to 20, or inside a specific additional compartment, a cosmetic accessory, such as a mirror or an applicator for example. In this case, the compartment may be provided with removable means of attachment to secure the applicator.

As previously mentioned, the tray 12 is designed to allow the snap-fitting of an additional tray from below. As shown more clearly on FIG. 5, the hole 34 of the tray delimits an annular groove 38, and an annular retaining rib 39 which forms a snapping element adapted to interact with the protrusions of an additional tray.

The groove 38 and the rib 39 of the tray are respectively identical to the groove 28 and the rib 29 of the lid. The rib 39 is axially disposed above the groove 38. The top surface of the rib 39 forms the bottom surface of the groove 38. The groove 38 and the rib 39 are axially located into the thickness of the tray 12. The groove 38 extends radially outwards and the rib 39 extends radially inwards.

Figure 8:
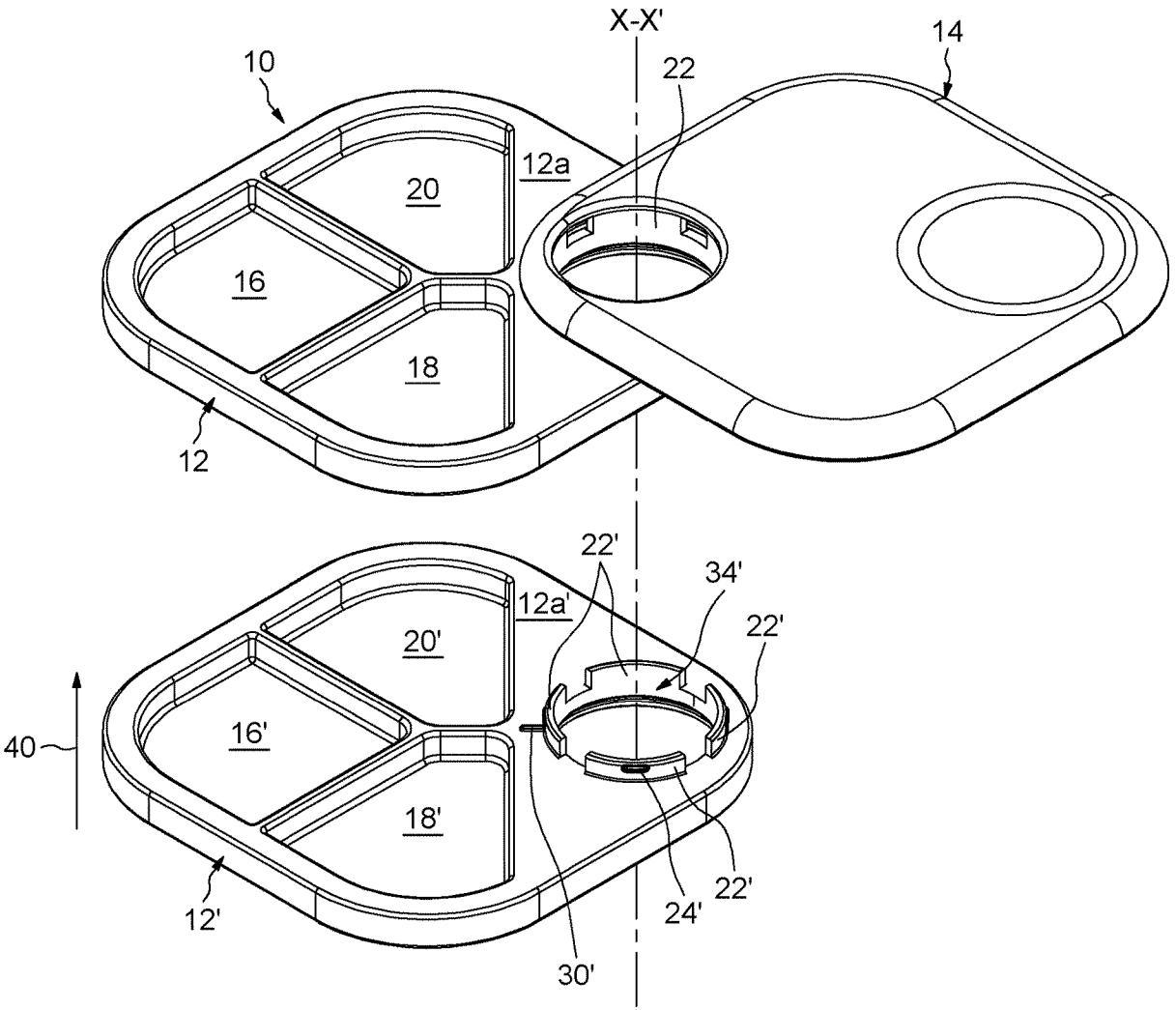
FIGS. 8 to 10 are perspective views of the packaging device of FIGS. 1 and 2 before and after the mounting of an additional tray.
Figure 9:
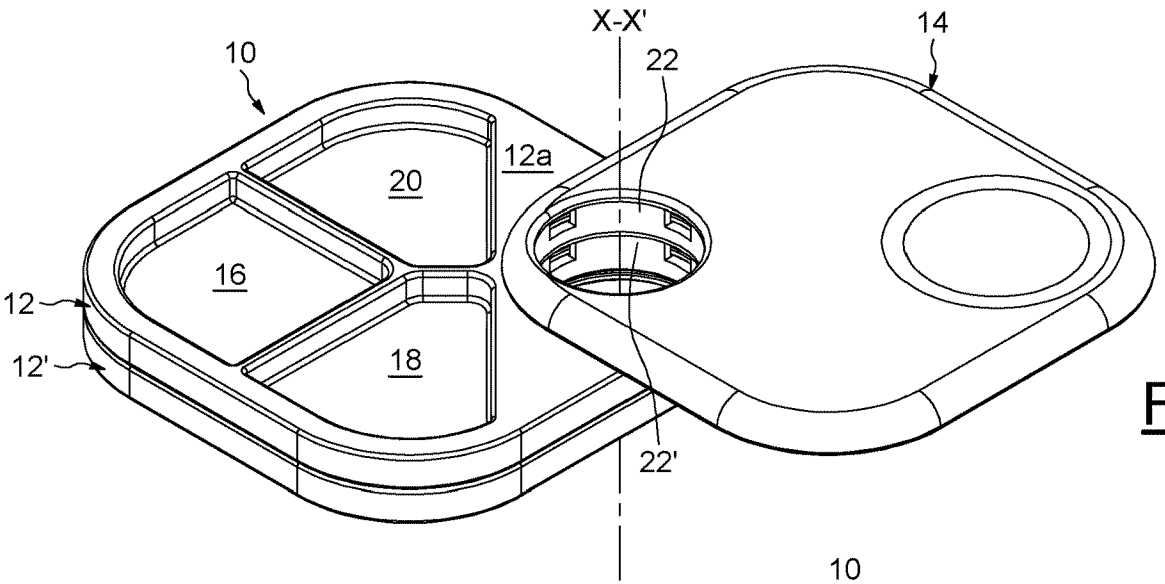
Figure 10:
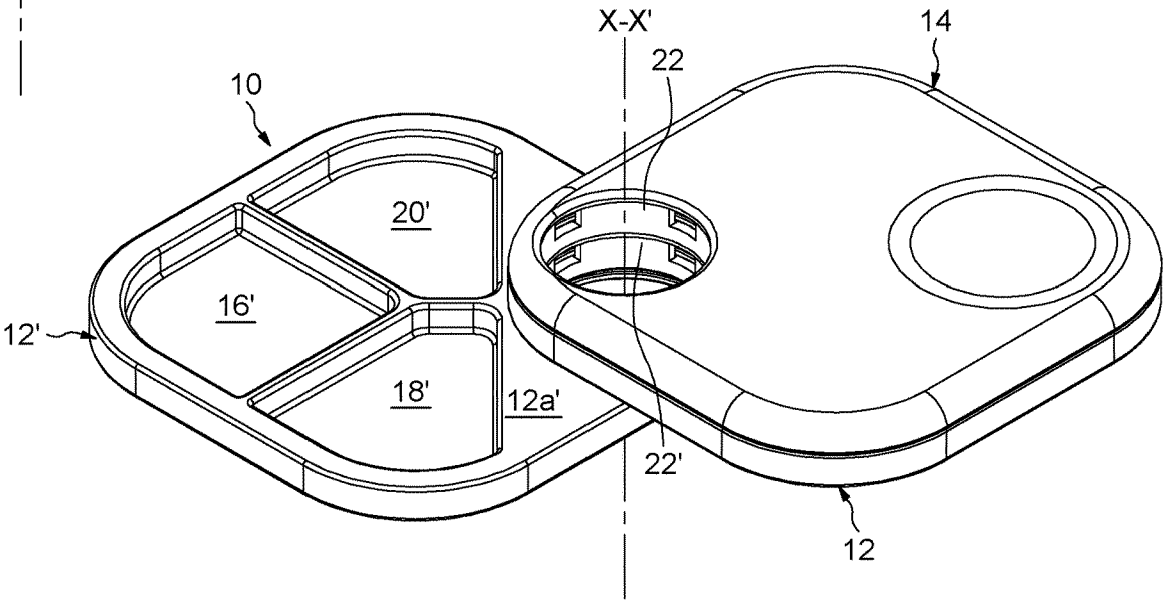

As shown on FIGS. 8 to 10, an additional tray 12' can be mounted by snap-fitting on the tray 12 axially on the side opposite to the lid 14. The tray 12' is similar to the tray 12. Since the two trays 12, 12' are identical, the tray 12' will be not described here.

The additional tray 12' is mounted on the tray 12 with a simple axial pushing movement illustrated schematically by the arrow 40 on FIG. 8.

In the mounted position of the additional tray 12' on the tray 12 as shown on FIG. 9, the pin 22' of the additional tray extends into the hole 34 (FIG. 5) of the main tray and the protrusions 24' of said pin 22' are engaged within the groove 38 of the main tray 12. The bottom surface of each protrusion 24' axially bears against the top surface of the rib 39 (FIG. 5) of the tray 12. The external diameter of the protrusions 24' is greater than the inner diameter of the rib 39 so that a diametral interference exists between the additional tray 12' and the tray 12 to prevent an axial displacement of said additional tray downwards. The rib 39 of the tray 12 forms a snapping element cooperating by contact with complementary snapping elements of the additional tray 12' formed by the protrusions 24'.

The lid 14 and the main tray 12 are separately and independently pivotable relative to one another. The main tray 12 is rotatably mounted on the additional tray 12' around the axis X-X'. Thus, the lid 14 and the main tray 12 are rotatably mounted around the common rotation axis X-X'. The main tray 12 is movable between a closed storage position (FIG. 9) in which said tray covers the compartments 16' to 20' of the additional tray, and at least one open use position (FIG. 10).

In the illustrated example, the additional tray 12' is clipped onto the tray 12. Alternatively, if the compartments 16 to 20 are empty, the user can replace the tray 12 with the additional tray 12'.

In the illustrated example, only one additional tray 12' is clipped onto the main tray 12. Alternatively, a plurality of superimposed additional trays can be clipped onto each other, the upper additional tray being clipped onto the main tray 12.

With the packaging device according to the present invention, the user can assemble one or several additional trays from below to make its own pallet.

The invention claimed is:

1. A packaging device comprising:

a main tray provided with an upper face delimiting at least one compartment receiving at least one cosmetic product and/or at least one cosmetic accessory, and a lid rotatably mounted on the main tray between a closed position in which said lid covers said at least one compartment of the main tray, and at least one open position allowing access to said at least one compartment, wherein the lid is provided with a lower face and an opposite upper face which forms an uppermost face of said packaging device, wherein the main tray comprises a pin protruding with respect to the upper face and around which is rotatably mounted the lid, wherein the main tray further comprises a hole extending from a lower face of said main tray and adapted for receiving a pin of an additional tray, said hole opening onto an upper face of said main tray, wherein the lid comprises a through-hole which is coaxial with the hole of the main tray to collectively extend throughout an entire thickness of said packaging device, wherein said lid comprises at least one snapping element cooperating with at least one complementary snapping element of the pin, wherein said hole of the main tray being configured to delimit at least one snapping element adapted to cooperate with at least one complementary snapping element of the pin of said additional tray.

2. The packaging device according to claim 1, wherein the pin (22) and the hole (34) of the main tray are arranged coaxially.

3. The packaging device according to claim 1, wherein the through-hole (26) of the lid is configured to delimit the at least one snapping element (29) of said lid.

4. The packaging device according to claim 1, wherein the at least one snapping element (39) of the hole (34) of the main tray is identical to the snapping element (29) of the lid (14).

5. The packaging device according to claim 1, wherein the pin (22) of the main tray comprises at least one protrusion extending radially outwards and forming the complementary snapping element (24), and the lid (14) comprises at least one rib forming the snapping element (29).

6. The packaging device according to claim 1, wherein at least one of the upper face (12*a*) of the main tray and the lower face (14*a*) of the lid comprises at least one locking rib (30) engaging into a complementary recess (32) of the other in the closed position of said lid.

7. The packaging device according to claim 1, wherein, in the closed position, the lid (14) overlaps the main tray (12) and is superposed relative to said main tray.

8. The packaging device according to claim 1, wherein a finger depression (36) is formed on an upper face (14*b*) of the lid and is adapted to receive at least one finger of a user.

9. The packaging device according to claim 1, wherein the upper face (12*a*) of the main tray delimits a plurality of compartments (16, 18, 20).

10. The packaging device according to claim 9, wherein the plurality of compartments (16, 18, 20) contains different cosmetic products and/or different cosmetic accessories.

11. The packaging device according to claim 1, wherein the additional tray (12') is identical to the main tray (12) and mounted on said main tray axially on the side opposite to the lid (14), the at least one snapping element (39) of the hole (34) of the main tray (12) cooperating with the at least one complementary snapping element (24') of the pin (22') of the additional tray (12'), the main tray (12) being rotatably mounted around said pin on the additional tray (12') between a closed position in which said main tray covers the at least one compartment (16') of the additional tray, and at least one open position allowing access to said at least one compartment.

12. The packaging device according to claim 1, wherein each of the main tray (12) and the lid is made in one part, notably from moulding of plastic material.

13. A packaging device comprising:

a main tray provided with an upper face delimiting at least one compartment receiving at least one cosmetic product and/or at least one cosmetic accessory, and a lid rotatably mounted on the main tray between a closed position in which said lid covers said at least one compartment of the main tray, and at least one open position allowing access to said at least one compartment, wherein the lid is provided with a lower face and an opposite upper face, wherein the main tray comprises a pin protruding with respect to the upper face and around which is rotatably mounted the lid, wherein the main tray further comprises a hole extending from a lower face of said main tray and adapted for receiving a pin of an additional tray, said hole opening onto an upper face of said main tray, wherein the lid comprises a through-hole which is coaxial with the hole of the main tray to collectively extend throughout an entire thickness of said packaging device, wherein the upper face of the lid is deprived of pin, and the lower and upper faces of the lid delimit thickness of said lid, wherein said lid comprises at least one snapping element cooperating with at least one complementary snapping element of the pin, wherein said hole of the main tray being configured to delimit at least one snapping element adapted to cooperate with at least one complementary snapping element of the pin of said additional tray.

14. A packaging device comprising:

a main tray provided with an upper face delimiting at least one compartment receiving at least one cosmetic product and/or at least one cosmetic accessory, and a lid rotatably mounted on the main tray between a closed position in which said lid covers said at least one compartment of the main tray, and at least one open position allowing access to said at least one compartment, wherein the lid is provided with a lower face and an opposite upper face, wherein the upper face of the lid is deprived of compartment receiving at least one cosmetic product and/or at least one cosmetic accessory, wherein the main tray comprises a pin protruding with respect to the upper face and around which is rotatably mounted the lid, wherein the main tray further comprises a hole extending from a lower face of said main tray and adapted for receiving a pin of an additional tray, said hole opening onto the upper face of said main tray, wherein the lid comprises a through-hole which is coaxial with the hole of the main tray to collectively extend throughout an entire thickness of said packaging device, wherein said lid comprises at least one snapping element cooperating with at least one complementary snapping element of the pin, wherein said hole of the main tray being configured to delimit at least one snapping element adapted to cooperate with at least one complementary snapping element of the pin of said additional tray.

* * * * *